US009451689B2

(12) United States Patent
Tsutsui

(10) Patent No.: US 9,451,689 B2
(45) Date of Patent: Sep. 20, 2016

(54) CYCLOTRON

(71) Applicant: Sumitomo Heavy Industries, Ltd., Tokyo (JP)

(72) Inventor: Hiroshi Tsutsui, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 103 days.

(21) Appl. No.: 13/962,392

(22) Filed: Aug. 8, 2013

(65) Prior Publication Data

US 2014/0042934 A1 Feb. 13, 2014

(30) Foreign Application Priority Data

Aug. 13, 2012 (JP) ..... 2012-179441

(51) Int. Cl.
*H05H 13/00* (2006.01)
*H05H 13/02* (2006.01)
*H05H 7/04* (2006.01)

(52) U.S. Cl.
CPC ..... *H05H 13/02* (2013.01); *H05H 7/04* (2013.01); *H05H 13/005* (2013.01)

(58) Field of Classification Search
USPC ..... 315/502, 503, 504, 501
See application file for complete search history.

(56) References Cited

U.S. PATENT DOCUMENTS 2,789,221 A * 4/1957 Tobias ..... H05H 13/00 313/363.1
2,812,463 A * 11/1957 Teng ..... H05H 13/00 313/62
4,641,057 A * 2/1987 Blosser ..... H05H 7/20 313/62
5,874,811 A * 2/1999 Finlan ..... H05H 6/00 313/62
6,683,426 B1 * 1/2004 Kleeven ..... H05H 7/10 315/500
9,142,385 B1 * 9/2015 Iwanaga ..... H01J 37/1472
2006/0286729 A1 * 12/2006 Kavalieros ..... H01L 21/28079 438/183
2007/0171015 A1 * 7/2007 Antaya ..... H05H 7/04 335/216
2013/0114773 A1 * 5/2013 Vaucher ..... G21G 4/02 376/112
2013/0249443 A1 * 9/2013 Antaya ..... H05H 13/005 315/502
2013/0270451 A1 * 10/2013 Verbruggen ..... H05H 13/02 250/396 R
2014/0042934 A1 * 2/2014 Tsutsui ..... H05H 13/02 315/502
2014/0371511 A1 * 12/2014 Zwart ..... A61N 5/1077 600/1
2015/0043717 A1 * 2/2015 Chen ..... H05H 11/04 378/101
2015/0170775 A1 * 6/2015 Nutt ..... H05H 6/00 376/202
2015/0231411 A1 * 8/2015 O'Neal, III ..... A61N 5/1043 600/1
2015/0238918 A1 * 8/2015 Khachaturian .... A61K 51/0491 422/117
2015/0305135 A1 * 10/2015 Korenev ..... H05H 7/001 250/396 R
2015/0360057 A1 * 12/2015 Balakin ..... A61N 5/1081 600/1

OTHER PUBLICATIONS

XiaoYu Wu, "Conceptual Design and Orbit Dynamics in a 250 MeV Superconducting Synchrocyclotron", Ph. D. Thesis, Michigan State University, 172 pages, 1990.

* cited by examiner

*Primary Examiner* — Adam Houston
(74) *Attorney, Agent, or Firm* — Michael Best and Friedrich

(57) ABSTRACT

A cyclotron includes: a regenerator configured to move a beam of a charged particle on an orbit outward in a radial direction; and a magnetic channel configured to put the beam on an extraction orbit. The regenerator includes a pair of magnetic members for a regenerator. The magnetic member for a regenerator includes a first portion including a portion approaching the median plane as it goes outward in a radial direction and having an apex closest to the median plane. When viewed from the circumferential direction, assuming that a distance between the centerline of the apex in the radial direction and a first reference position set on a radially inner end side of the first portion is a first distance and a distance between the centerline and a second reference position set on a radially outer end side of the first portion is a second distance, the first distance is greater than the second distance.

19 Claims, 11 Drawing Sheets

CYCLOTRON

INCORPORATION BY REFERENCE

Priority is claimed to Japanese Patent Application No. 2012-179441, filed Aug. 13, 2012, the entire content of each of which is incorporated herein by reference.

BACKGROUND

1. Technical Field

The present invention relates to a cyclotron that accelerates a charged particle.

2. Description of the Related Art

A cyclotron (isochronous cyclotron and synchrocyclotron) is an apparatus that accelerates charged particles sent from an ion source along the spiral orbit in the acceleration space by the action of the magnetic field and the electric field. The beam of charged particles on the orbit moves outward in a radial direction by passing through a regenerator, and is emitted out of the cyclotron by passing through a magnetic channel, a 4-pole permanent magnet, or the like. The magnetic channel has a function of directing a beam outward in a radial direction by weakening the magnetic field locally so that the beam is put on the extraction orbit. As the shape of a regenerator used in such a cyclotron, a shape disclosed in [XiaoYu Wu, "Conceptual Design and Orbit Dynamics in a 250 MeV Superconducting Synchrocyclotron" Ph. D. Thesis, submitted to Michigan State University] is known. This regenerator has a pair of upper and lower magnetic members with a median plane interposed therebetween, and each of the magnetic members has a protruding shape that protrudes toward the median plane side. Accordingly, the generated magnetic field has a substantially normal distribution (for example, refer to FIG. 6). Thus, by increasing the magnetic field to realize a resonance state, the beam is moved outward in a radial direction.

SUMMARY

According to an embodiment of the present invention, a cyclotron includes: a regenerator configured to move a beam of a charged particle on an orbit outward in a radial direction; and a magnetic channel configured to put the beam on an extraction orbit. The regenerator includes a pair of magnetic members for a regenerator facing each other with a median plane of the beam interposed therebetween. Each of the magnetic members for a regenerator includes a first portion that approaches the median plane as it goes outward in a radial direction, and includes an apex closest to the median plane. Assuming that a distance between a centerline of the apex in a radial direction and a first reference position set on a radially inner end side of the first portion is a first distance and a distance between the centerline and a second reference position set on a radially outer end side of the first portion is a second distance, the first distance is greater than the second distance.

DETAILED DESCRIPTION

Figure 1:
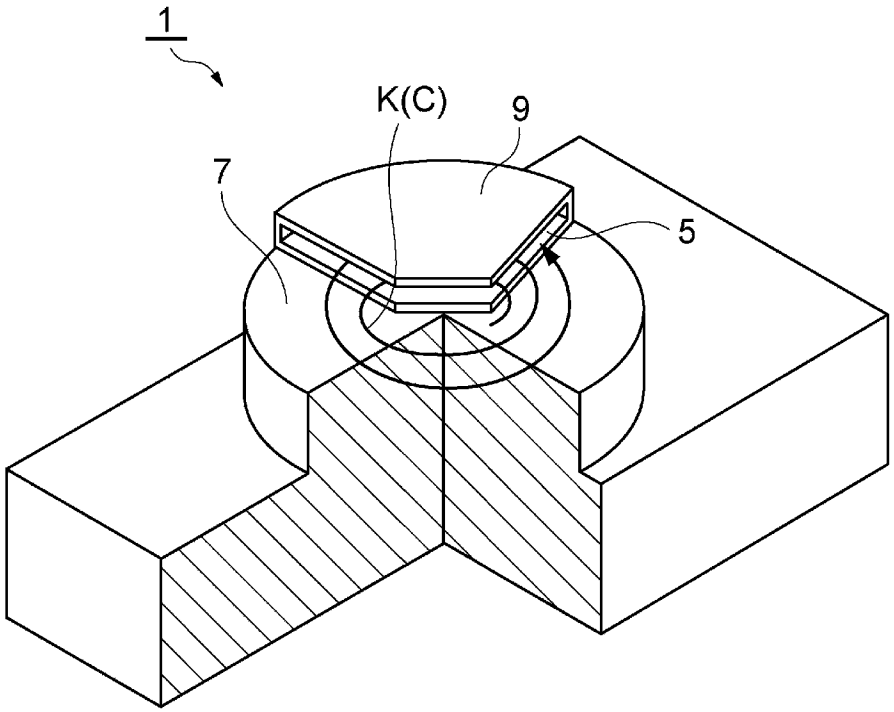
FIG. 1 is a perspective view showing the schematic configuration of a cyclotron according to an embodiment of the present invention.

In recent years, demands for miniaturization of the cyclotron have been growing. For example, although the beam emitted from the cyclotron is used in a charged particle beam treatment apparatus for performing treatment of cancer cells or the like, miniaturization of the cyclotron has also been required due to the demand for the miniaturization of such a treatment apparatus. However, when the size of the cyclotron is reduced, the orbit of a beam passing through the regenerator is brought close to the extraction orbit of a beam passing through a magnetic channel adjacent to the regenerator on the outside in a radial direction. In such a case, since a high magnetic field generated by the regenerator interferes with a magnetic field generated by the magnetic channel, the beam passing through the magnetic channel may not be satisfactorily extracted. On the other hand, since a magnetic field generated by the magnetic channel interferes with a magnetic field generated by the regenerator, a resonance state may be destroyed and the beam may not be able to be moved outward in a radial direction satisfactorily. Therefore, in order to accurately extract a beam of charged particles, the regenerator and the magnetic channel should be separated from each other in the radial direction to some extent. For this reason, there has been a problem that the size reduction of the cyclotron is difficult.

It is desirable to provide a cyclotron that can be reduced in size and can extract a beam accurately.

In the cyclotron according to the embodiment of the present invention, each magnetic member for a regenerator of the regenerator includes a first portion that approaches the median plane as it goes outward in a radial direction, and has an apex closest to the median plane. Therefore, since a region where the magnetic field increases can be formed from the inner side in the radial direction to the apex, it is possible to move the beam outward in a radial direction by making the beam of charged particles pass through the region. On the other hand, assuming that the distance between the centerline of the apex in the radial direction and the first reference position set on the radially inner end side of the first portion is the first distance and the distance between the centerline and the second reference position set on the radially outer end side of the first portion is the second distance, the first distance is greater than the second distance. That is, by adopting a configuration, in which the amount of the magnetic member for a regenerator is suppressed to be low, on the outer side in the radial direction than the centerline of the apex, it is possible to reduce a magnetic field in a region on the outer side in the radial direction than the centerline of the apex. Accordingly, even if the magnetic channel is brought close to the regenerator due to being disposed on the inner side in the radial direction, it is possible to suppress the influence of the magnetic field generated by the regenerator on the extraction of the beam of charged particles by the magnetic channel. In this manner, it is possible to extract the beam accurately while reducing the size of the cyclotron.

In addition, in the cyclotron according to the embodiment of the present invention, the second reference position may be set at a radially outer end of the first portion.

In addition, in the cyclotron according to the embodiment of the present invention, it is preferable that the first reference position be set at a position where a magnetic field, which is larger than ¼ of a magnetic field generated by the apex, is generated. When a portion, which has a small amount of magnetic members for a regenerator and has a little influence on the magnetic member near the apex, is present near the radially inner end of the first portion, the portion is not set at the first reference position, and the first reference position can be set for a portion having a large influence on the magnetic member near the apex. Accordingly, it is possible to compare the first and second distances in consideration of the substantial influence of the magnetic field.

In addition, in the cyclotron according to the embodiment of the present invention, it is preferable that the magnetic channel include a magnetic member for a magnetic channel disposed on an outer side of the magnetic member for a regenerator in the radial direction. Assuming that a distance between the centerline and a radially inner end of the magnetic member for a magnetic channel is a third distance, it is preferable that the first distance be equal to or greater than the third distance. Thus, by arranging the magnetic member for a magnetic channel of the magnetic channel close to the magnetic member for a regenerator, it is possible to reduce the size of the cyclotron.

In addition, in the cyclotron according to the embodiment of the present invention, it is preferable that a radially outer end of the first portion of the magnetic member for a regenerator be adjacent to the apex on the outside in a radial direction and be perpendicular to the median plane and extend to an opposite side of the median plane and that the second reference position be set at a radially outer end of the first portion. By adopting such a configuration, the amount of the magnetic member for a regenerator in a region on the outer side in the radial direction than the apex can be reduced. As a result, it is possible to reduce the magnetic field of the region.

In addition, in the cyclotron according to the embodiment of the present invention, it is preferable that the magnetic member for a regenerator have a second portion, which protrudes to the median plane side, on an inner side in the radial direction than the first portion and the second portion protrude to the median plane side more than a portion adjacent to the second portion on the outside in a radial direction. For example, when a region where the magnetic field is lower than 0 is formed on the inner side in the radial direction than the centerline of the apex, the orbit of the beam of charged particles may be distorted. However, it is possible to suppress a reduction in the magnetic field by providing the second portion protruding to the median plane side. As a result, since it is possible to make smooth the magnetic field on the inner side in the radial direction, it is possible to reduce the distortion of the orbit of the beam.

In addition, in the cyclotron according to the embodiment of the present invention, it is preferable that, in the radial direction, the magnetic member for a magnetic channel be in contact with the magnetic member for a regenerator. In this case, it is possible to further reduce the size of the cyclotron.

In addition, in the cyclotron according to the embodiment of the present invention, it is preferable to further include another magnetic channel that is provided on an upstream side of the magnetic channel in a direction of the beam and on a downstream side of the regenerator in the direction of the beam. Another magnetic channel is preferably formed of a coil. Since it is possible to reduce a leakage magnetic field by forming another magnetic channel using a coil, the beam of charged particles can be easily extracted.

In addition, the cyclotron according to the embodiment of the present invention may be a synchrocyclotron.

Hereinafter, an embodiment of the present invention will be described with reference to the accompanying drawings. In addition, in the explanation of the drawings, the same components are denoted by the same reference numerals and repeated explanation thereof will be omitted.

Figure 2:
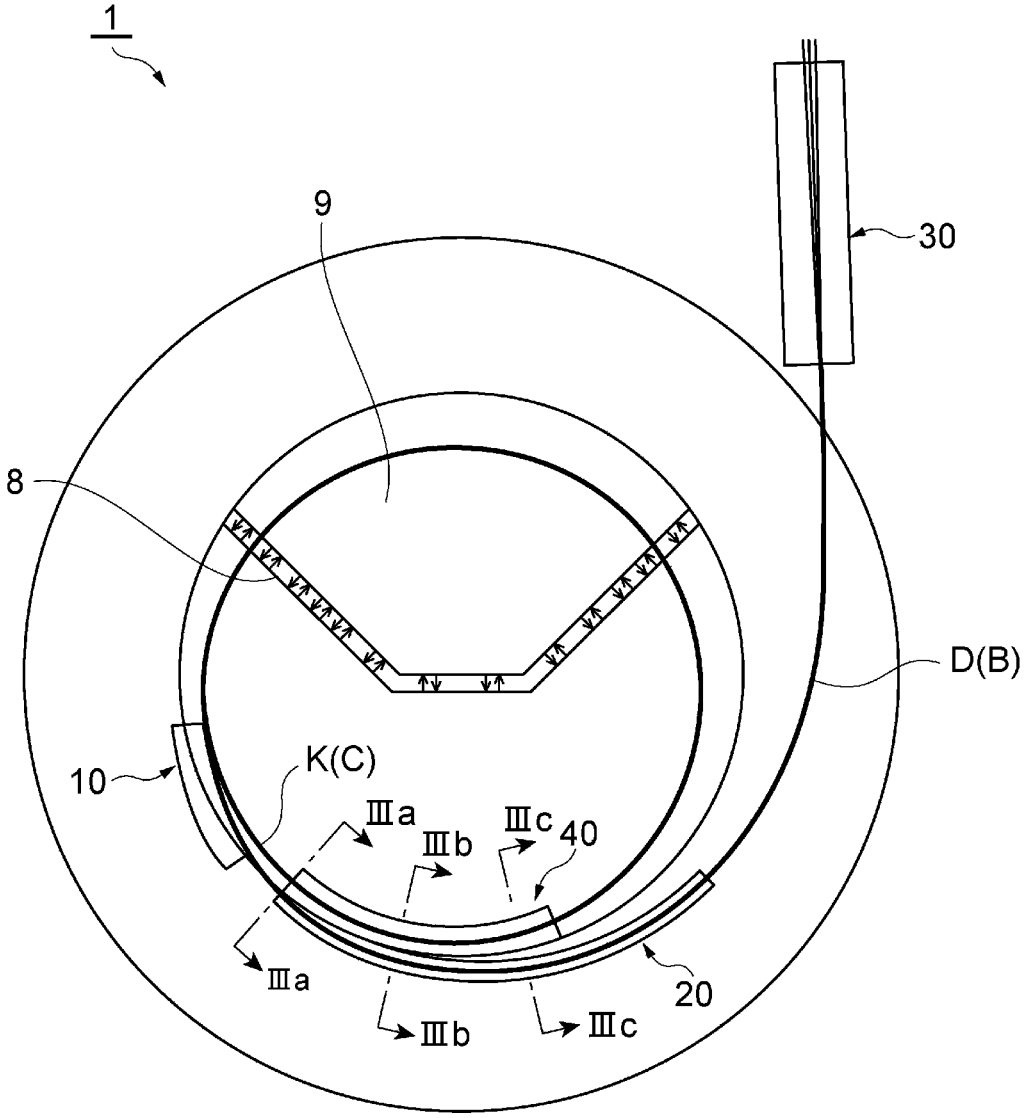
FIG. 2 is a top view showing the schematic configuration of the cyclotron according to the embodiment of the present invention.

FIG. 1 is a perspective view showing the schematic configuration of a cyclotron 1 according to the present embodiment. FIG. 2 is a top view showing the schematic configuration of the cyclotron 1 according to the present embodiment. As shown in FIG. 1, the cyclotron 1 is an accelerator that accelerates and outputs a beam C of charged particles incident from a charged particle source (not shown). As charged particles, for example, protons, heavy particles (heavy ions), electrons, and the like can be mentioned. The cyclotron 1 includes acceleration space 5 which has a circular shape in plan view and through which the beam C passes to be accelerated. Here, it is assumed that the cyclotron 1 is placed so that the acceleration space 5 extends horizontally. When using words including the concept of "top" and "bottom" in the following explanation, it is assumed that they correspond to the top and bottom of the cyclotron 1 in a state shown in FIG. 1.

In addition, the "cyclotron" according to the embodiment of the present invention may include both an isochronous cyclotron and an isochronous synchrocyclotron.

The cyclotron 1 includes poles 7 provided above and below the acceleration space 5. In addition, the pole 7 provided above the acceleration space 5 is not shown in the drawings. The pole 7 generates a magnetic field in the vertical direction in the acceleration space 5. In addition, the cyclotron 1 includes a D electrode 9 having a fan shape in plan view. The D electrode 9 has a cavity penetrating therethrough in the circumferential direction, and the cavity forms a part of the acceleration space 5. In addition, a dummy D electrode 8 (not shown in FIG. 1) is provided at a position facing the end of the D electrode 9 in the circumferential direction. When the high-frequency AC current is applied to the D electrode 9, the D electrode 9 and the dummy D electrode 8 generate an electric field in the circumferential direction in the acceleration space 5, and the beam C is accelerated by the electric field. The beam C introduced to the approximate middle of the acceleration space 5 is accelerated while drawing the horizontal spiral orbit K in the acceleration space 5 by the action of the magnetic field due to the pole 7 and the electric field due to the D electrode 9. The accelerated beam C is finally output in the tangential direction of the orbit K. Since the above configuration of the cyclotron 1 is known, further detailed explanation thereof will be omitted. The poles 7 vertically face each other, and the direction of the magnetic field is from below to above. In the following explanation, the "vertical direction" can be rephrased as a "direction parallel to the direction of the magnetic field", and "above" and "below" can be rephrased as "one side of the direction parallel to the direction of the magnetic field" and "the other side of the direction parallel to the direction of the magnetic field", respectively.

As shown in FIG. 2, the beam C accelerated on the orbit K passes through a regenerator 40, a first magnetic channel 10, and a second magnetic channel 20 and is put on the extraction orbit D. Then, the beam C passes through a 4-pole magnet 30 and is extracted to the outside of the cyclotron 1. In order from the upstream side of the beam C, the regenerator 40, the first magnetic channel 10, the second magnetic channel 20, and the 4-pole magnet 30 are disposed. The regenerator 40 has a function of moving the beam C on the orbit K outward in a radial direction. Each of the first and second magnetic channels 10 and 20 has a function of putting the beam C on the extraction orbit D. The second magnetic channel 20 is disposed so as to be adjacent to the regenerator 40 on the outside in a radial direction. The first magnetic channel 10 is located on the upstream side of the second magnetic channel 20 in a direction of the beam C, and is disposed at a position not adjacent to the regenerator 40 in the radial direction. Moreover, third and fourth (or higher) magnetic channels may be further provided in addition to the magnetic channels shown in the drawing. The 4-pole magnet 30 has a function of focusing the beam. In addition, each magnetic channel is connected to a support member extending toward the inside from the return yoke of the cyclotron 1.

Figure 3:
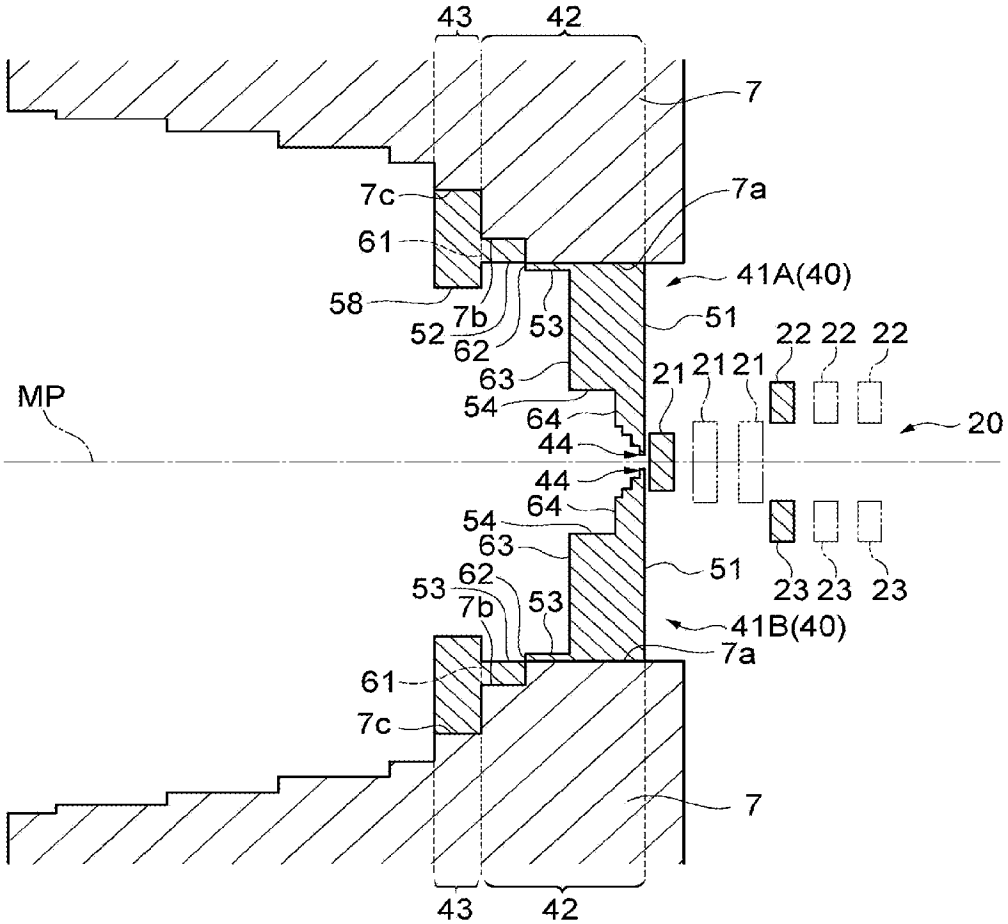
FIG. 3 is a cross-sectional view when a pole, a regenerator, and a second magnetic channel are viewed from the circumferential direction.

The detailed configuration of the regenerator 40 and the second magnetic channel 20 will be described with reference to FIG. 3. In addition, FIG. 3 is a cross-sectional view when the pole 7, the regenerator 40, and the second magnetic channel 20 are viewed from the circumferential direction. A portion shown by the solid line in FIG. 3 is a cross-section taken along the line IIIa-IIIa shown in FIG. 2, a portion shown by the one-dot chain line is a cross-section taken along the line IIIb-IIIb, and a portion shown by the two-dot chain line is a cross-section taken along the line IIIc-IIIc. In addition, the following explanation will be given using the term "median plane (MP)" as a plane to draw a spiral while the beam C of charged particles is being accelerated. The median plane MP is set at the middle position in the vertical direction between the upper and lower poles 7, and is also set so as to be parallel to the bottom surface of the upper pole 7 and the top surface of the lower pole 7. However, the median plane MP is a plane as a reference in acceleration of charged particles, and strictly speaking, the charged particles do not always exist on the median plane MP.

The regenerator 40 includes a pair of magnetic members for a regenerator 41A and 41B facing each other with the median plane MP of the beam C interposed therebetween. The magnetic members for a regenerator 41A and 41B are provided near the outer edge in the radial direction of the pole 7. The magnetic member for a regenerator 41A is fixed to the bottom surface of the upper pole 7, and extends downward from the bottom surface toward the median plane MP. The magnetic member for a regenerator 41B is fixed to the top surface of the lower pole 7, and extends upward from the top surface toward the median plane MP. The magnetic members for a regenerator 41A and 41B extend in the circumferential direction in a state of having a fixed cross-sectional shape. Distances of the magnetic members for a regenerator 41A and 41B from the central axis of the cyclotron 1 are constant. The materials of the magnetic members for a regenerator 41A and 41B are not particularly limited as long as they are magnetic materials. For example, iron, cobalt-iron alloy, nickel, and the like can be used.

In addition, near the outer edge in the radial direction, the upper pole 7 is formed so as to approach to the median plane MP stepwise since it protrudes downward in a stepwise manner as it goes outward in a radial direction. Among the bottom surfaces of the pole 7, a plane 7*a* on the outermost side in the radial direction is a surface closest to the median plane. In addition, the pole 7 has a flat surface 7*b*, which is a second bottom surface from the outer side in the radial direction, and a flat surface 7*c*, which is a third bottom surface from the outer side in the radial direction (and has flat surfaces of a plurality of stages thereafter). The pole 7 has a shape plane-symmetrical to the upper pole 7 with respect to the median plane MP. As a material of the pole 7, for example, iron, cobalt-iron alloy, and the like can be used.

The cross-sectional shape (cross-sectional shape shown in FIG. 3) of the magnetic member for a regenerator 41A when viewed from the circumferential direction will be described. The magnetic member for a regenerator 41A has a first portion 42 on the outer side in the radial direction, and has a second portion 43 on the inner side in the radial direction than the first portion 42. In addition, since the lower magnetic member for a regenerator 41B has a shape plane-symmetrical to the upper magnetic member for a regenerator 41A with respect to the median plane MP as a plane of symmetry, only the upper magnetic member for a regenerator 41A will be described below.

The first portion 42 approaches the median plane MP as it goes outward in a radial direction, and also has an apex 44 closest to the median plane MP. In the present embodiment, in a region on the inner side in the radial direction than the apex 44, the first portion 42 approaches the median plane MP stepwise as it goes outward in a radial direction. That is, the first portion 42 of the magnetic member for a regenerator 41A is formed so as to approach the median plane MP stepwise since it protrudes downward in a stepwise manner as it goes outward in a radial direction. By adopting such a shape, a plurality of surfaces rising vertically downward (arc surfaces extending in the circumferential direction) and a plurality of flat surfaces parallel to the median plane MP are formed in the first portion 42. The first portion 42 has a side surface 51 on the outer side in the radial direction than the apex 44. The side surface 51 is adjacent to the apex 44 on the outside in a radial direction, is perpendicular to the median plane MP, and also extends to the opposite side (that is, upper side) of the median plane MP.

The second portion 43 is a portion that is disposed on the inner side in the radial direction than the first portion 42 and that protrudes to the median plane MP side. The second portion 43 protrudes to the median plane MP side more than a portion adjacent to the second portion 43 on the outside in a radial direction. Here, the second portion 43 protrudes to the median plane MP side more than a portion (away from the median plane MP most) of the first portion 42 disposed on the innermost side in the radial direction. In addition, the shape of the second portion 43 is not particularly limited, and the second portion 43 may protrude in a rectangular cross-sectional shape as shown in FIG. 3, may protrude in a triangular shape, or may protrude in a curved shape.

Figure 4:
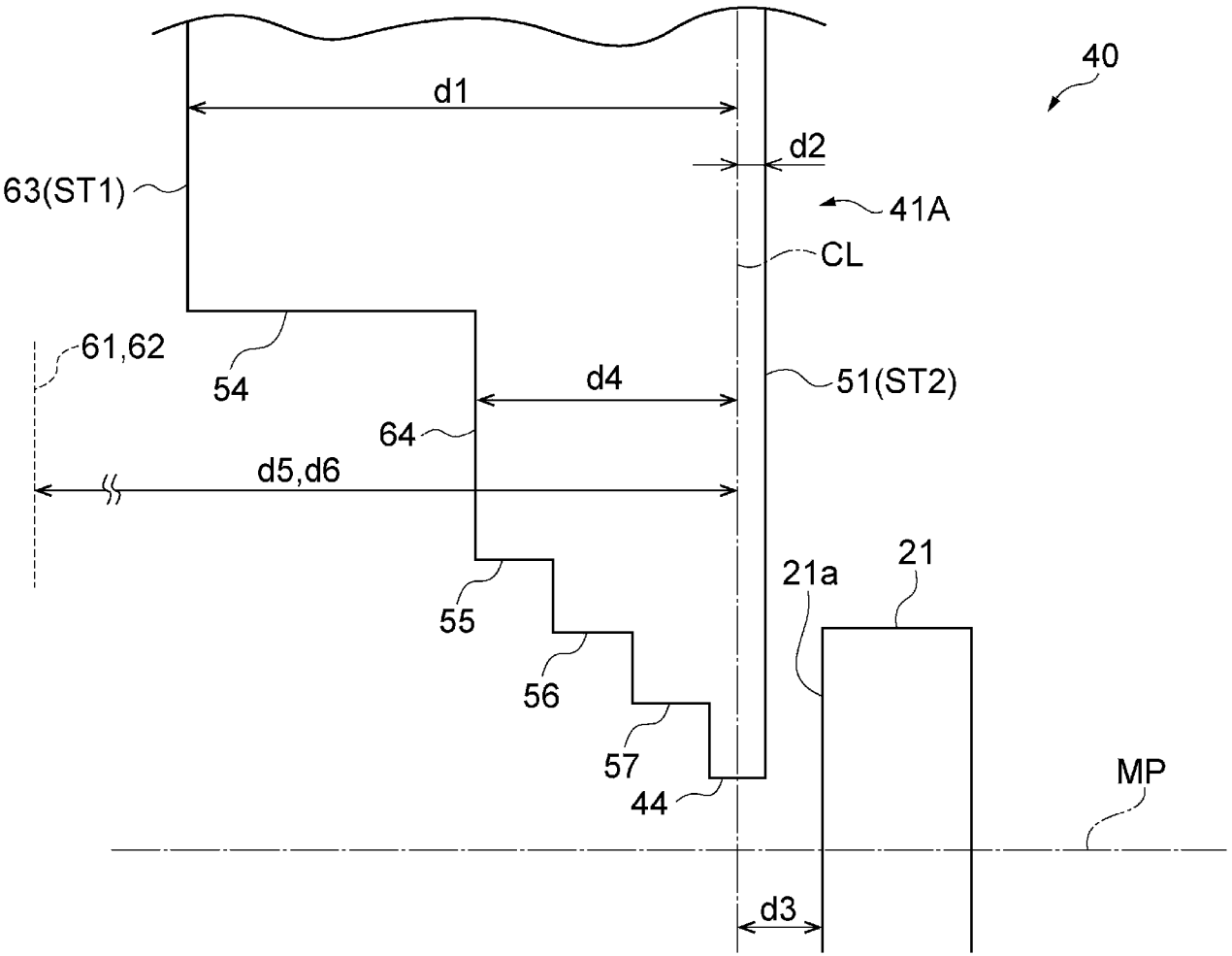
FIG. 4 is an enlarged sectional view showing the structure of a magnetic member for a regenerator, which is shown in FIG. 3, near the median plane.

Specifically, as shown in FIGS. 3 and 4, the first portion 42 has flat surfaces 52, 53, 54, 55, 56, and 57, which are parallel to the median plane MP, in order from the inside to the outside in the radial direction, and has the apex 44 that is a flat surface located on the outermost side in the radial direction and close to the median plane MP (refer to FIGS. 3 and 4). In addition, the flat surfaces 52, 53, 54, 55, 56, and 57 may not be parallel to the median plane MP. The flat surface 52 is formed at a position facing the flat surface 7*b* of the pole 7. The flat surfaces 53 to 57 and the apex 44 are formed at positions facing the plane 7*a*, which is located on the outermost side in the radial direction and is closest to the median plane MP, of the bottom surfaces of the pole 7. Among these, a magnetic member at a position corresponding to the flat surface 53 is thin, and magnetic members at positions corresponding to the flat surfaces 54 to 57 and the apex 44 largely protrude from the plane 7*a* of the pole 7 to the median plane MP side. In addition, magnetic members at positions corresponding to the flat surfaces 55 to 57 and the apex 44 protrude to the median plane MP side further than the flat surface 54. The flat surfaces 52 to 54 are spread at approximately the same pitches in the radial direction, and the flat surfaces 55 to 57 and the apex 44 provided on the outer side in the radial direction are spread at smaller pitches than the pitch of the flat surfaces 52 to 54. In the present embodiment, the side surface 51 adjacent to the apex 44 on the outside in a radial direction corresponds to the radially outer end of the first portion 42. A virtual side surface 61 (virtually spreading) perpendicular to the median plane MP from the edge of the flat surface 52 on the inner side in the radial direction corresponds to the radially inner end of the first portion 42. The virtual side surface 61 is a side surface that is formed when the second portion 43 is excluded and is adjacent to the flat surface 52 on the inside in a radial direction. In addition, it is preferable that the apex 44 be separated upward from the median plane MP by about 2 mm to 5 mm.

In addition, the second portion 43 has a flat surface 58, which is formed in parallel to the median plane MP, at a radially inner position adjacent to a portion (here, the flat surface 52) of the first portion 42 on the innermost side in the radial direction. The flat surface 58 is formed at a position facing the flat surface 7*c* of the pole 7. Since the flat surface 58 in the second portion 43 is formed so as to become closer to the median plane MP than the flat surface 52 adjacent to the flat surface 58 on the outside in a radial direction, a magnetic member corresponding to the flat surface 58 protrudes more to the median plane MP side than a magnetic member corresponding to the flat surface 52 does. In addition, the size of the flat surface 58 of the second portion 43 in the radial direction is approximately the same as sizes of the flat surfaces 52 to 54 of the first portion 42.

Next, the configuration of the second magnetic channel 20 will be described. The second magnetic channel 20 includes a magnetic member for a magnetic channel 21, which is disposed on the inner side in the radial direction, and magnetic members for a magnetic channel 22 and 23, which are disposed on the outer side in the radial direction than the magnetic member for a magnetic channel 21. The magnetic member for a magnetic channel 21 on the inner side in the radial direction is disposed on the median plane MP, and has a rectangular cross-sectional shape extending in a vertical direction. Top and bottom surfaces of the magnetic member for a magnetic channel 21 are spread in parallel to the median plane MP, and a side surface of the magnetic member for a magnetic channel 21 is vertically spread so as to be perpendicular to the median plane MP. A pair of magnetic members for a magnetic channel 22 and 23 on the outer side in the radial direction are disposed at positions separated vertically from the median plane MP with the median plane MP interposed therebetween, and each of the magnetic members for a magnetic channel 22 and 23 has a rectangular cross-sectional shape extending in a vertical direction. Top and bottom surfaces of the magnetic members for a magnetic channel 22 and 23 are spread in parallel to the median plane MP, and side surfaces of the magnetic members for a magnetic channel 22 and 23 are vertically spread so as to be perpendicular to the median plane MP. In addition, although the configuration in which the magnetic members for a magnetic channel 22 and 23 are divided (a pair of magnetic members for a magnetic channel 22 and 23 are disposed) as in the present invention is adopted for the beam convergence in the horizontal direction, the magnetic members for a magnetic channel 22 and 23 may not be divided when the beam convergence in the horizontal direction is not taken into consideration. The magnetic members for a magnetic channel 21, 22, and 23 extend along the extraction orbit D of the beam C. In addition, as is apparent from the one-dot chain line (cross-section taken along the line IIIb-IIIb of FIG. 2) and the two-dot chain line (cross-section taken along the line IIIc-IIIc of FIG. 2) in FIG. 3, the magnetic members for a magnetic channel 21, 22, and 23 are configured so as to be located on the outer side in the radial direction toward the downstream side of the extraction orbit D of the beam C. In addition, the first magnetic channel 10 has a similar configuration to the second magnetic channel 20. The materials of the magnetic members for a magnetic channel 21, 22, and 23 are not particularly limited as long as they are magnetic materials. For example, iron, cobalt-iron alloy, nickel, and the like can be used. In addition, the cross-sectional shapes of the magnetic members for a magnetic channel 21, 22, and 23 may be other shapes, such as a square, without being limited to the rectangular shape.

Next, the positional relationship between the regenerator 40 and the second magnetic channel 20 will be described with reference to FIG. 4.

In the first portion 42 of the magnetic member for a regenerator 41A of the regenerator 40, when viewed from the circumferential direction, a centerline CL in the radial direction can be set for the apex 44. A distance between the centerline CL and a first reference position ST1, which is set on a side of the radially inner end 61 of the first portion 42 is assumed to be a first distance d1. In addition, a distance between the centerline CL and a second reference position ST2, which is set on a side of the radially outer end 51 of the first portion 42 is assumed to be a second distance d2. In this case, the relationship that the first distance d1 is greater than the second distance d2 (d1>d2) is satisfied. In addition, preferably, the relationship of $\frac{2}{3}\times d1>d2$ may be satisfied, or the relationship of $\frac{1}{2}\times d1>d2$ may be satisfied, or the relationship of $\frac{1}{3}\times d1>d2$ may be satisfied. In addition, in terms of the cross-sectional area when viewed from the circumferential direction, in the first portion 42, the area of a region located on the inner side in the radial direction than the centerline CL is larger than the area of a region located on the outer side in the radial direction than the centerline CL.

It is preferable to set the first and second reference positions ST1 and ST2 in consideration of the shape of a portion, which largely influences the magnetic field near the apex 44, of the first portion 42 of the magnetic member for a regenerator 41A. In the present embodiment, in the first portion 42, a magnetic member corresponding to the flat surface 53 is formed to be thin, and magnetic members corresponding to the flat surfaces 54 to 57 and the apex 44 largely protrude to the median plane MP side. Thus, the influence of a largely protruding portion on the magnetic field near the apex 44 is large. Therefore, in the present embodiment, it is preferable to set the first reference position ST1 at the position of a side surface 63 adjacent to the flat surface 54 on the inside in a radial direction. On the outer side in the radial direction, the second reference position ST2 is set at the position of the side surface 51 that is a radially outer end of the first portion 42.

When determining the first reference position ST1, it is preferable to set the first reference position ST1 at a position where a magnetic field, which is larger than about ¼ of the magnetic field generated by a portion of the apex 44, is generated. In addition, the first reference position ST1 is set by comparison of the magnetic field on the median plane MP on which the beam C of charged particles is accelerated. In the present embodiment, the magnetic field generated by a portion of the apex 44 is a largest magnetic field on the median plane MP. That is, the magnetic field generated by a portion of the apex 44 is a magnetic field at the peak position on the median plane MP of the magnetic field generated by the apex 44. In addition, as shown in FIG. 4, for the first portion 42, it is also possible to set the first reference position ST1 at a side surface 64, an end of the first portion 42, and a side surface 62 and to set distances d4, d5, and d6 shown in the drawing as "first distances". However, it is more preferable to set the first reference position ST1 at the side surface 63 in consideration of the influence on the magnetic field.

Figure 6:
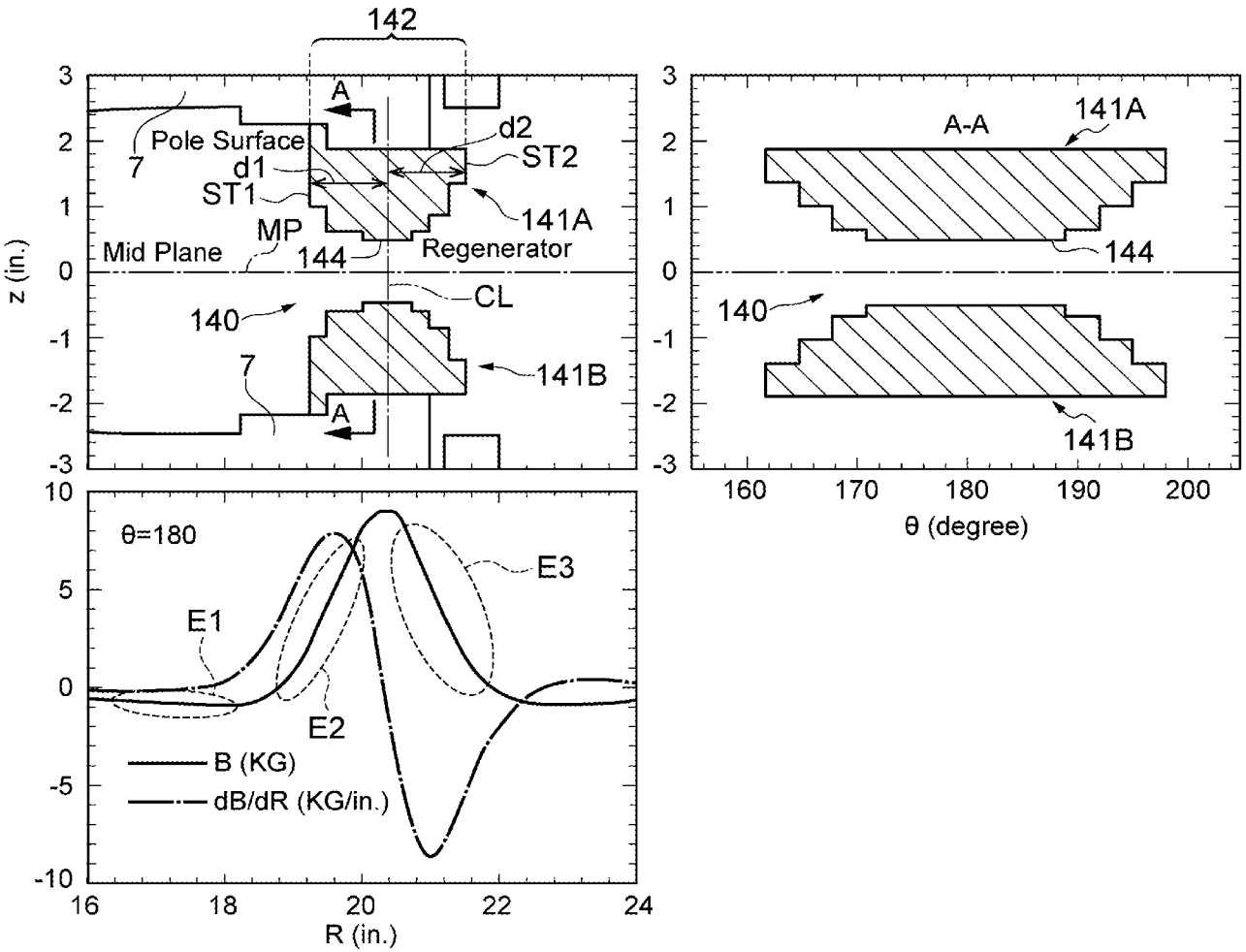
FIG. 6 is graphs showing the structure of a regenerator of a cyclotron in a comparative example and the relationship between the magnetic field and the radial position in the median plane.

In addition, a cross-section when the magnetic member for a regenerator 41A is cut along the centerline CL (cross-section when the magnetic member for a regenerator 41A is cut along the arc-shaped surface having the centerline of the cyclotron as the axis) may be a similar shape to a magnetic member for a regenerator 141A in a comparative example, as shown in the upper right diagram of FIG. 6. That is, the magnetic member for a regenerator 41A may have a shape in which it approaches the median plane MP stepwise toward the center from both ends of the circumferential direction and has the apex 44.

In addition, for the magnetic member for a magnetic channel 21 of the second magnetic channel 20 on the inner side in the radial direction, when viewed from the circumferential direction, a distance between the centerline CL and the radially inner end 21*a* (side surface on the inner side in the radial direction) of the magnetic member for a magnetic channel 21 is assumed to be a third distance d3. In this case, it is preferable that the relationship that the first distance d1 is equal to or greater than the third distance d3 (d1≥d3) be satisfied. In addition, although the magnetic member for a magnetic channel 21 is gradually separated from the magnetic member for a regenerator 41A along the circumferential direction, the dimensions at positions closest to the magnetic member for a regenerator 41A are compared. In addition, preferably, the relationship of ⅔×d1≥d3 may be satisfied, or the relationship of ½×d1≥d3 may be satisfied, or the relationship of ⅓×d1≥d3 may be satisfied. In addition, as shown in FIG. 3, the magnetic member for a magnetic channel 21 enters radially inward up to a region interposed between the upper and lower poles 7, and is disposed radially inward so as to be spaced apart from the magnetic member for a regenerator 41A with a slight gap therebetween (about 0 to 3 mm).

Next, the operation and effect of the cyclotron 1 according to the present embodiment will be described.

First, a regenerator 140 of a cyclotron in a comparative example will be described with reference to FIG. 6.

Specifically, as shown in the upper left diagram of FIG. 6, the magnetic member for a regenerator 141A of the regenerator 140 in a comparative example includes a first portion 142 that approaches the median plane MP stepwise as it goes outward in a radial direction and also has an apex 144 closest to the median plane MP. On the outer side in the radial direction than the apex 144, the first portion 142 is away from the median plane MP stepwise as it goes outward in a radial direction. In this comparative example, the first reference position ST1 on the inner side in the radial direction is set at the radially inner end of the first portion 142, and the second reference position ST2 on the outer side in the radial direction is set at the radially outer end of the first portion 142. In addition, assuming that the distance between the centerline CL in the radial direction of the apex 144 and the first reference position ST1 is d1 and the distance between the centerline CL and the second reference position ST2 is d2, the relationship of d1=d2 is satisfied. In addition, a cross-section taken along the line A-A shown in the upper left diagram of FIG. 6 (cross-section when the magnetic member for a regenerator 141A is cut along the arc-shaped surface having the centerline of the cyclotron as the axis) is shown in the upper right diagram of FIG. 6. The magnetic member for a regenerator 141A has a shape in which it approaches the median plane MP stepwise toward the center from both ends of the circumferential direction and has the apex 144. A magnetic member for a regenerator 141B has a similar shape.

On the inner side in the radial direction than the apex 144, the magnetic member for a regenerator 141A or 141B in the comparative example that has the above-described configuration approaches the median plane MP stepwise as it goes outward in a radial direction. Accordingly, as indicated by E2 of the graph at the lower left of FIG. 6, a region where the magnetic field increases is formed. By making the beam C of charged particles pass through the region of E2, it is possible to move the beam C outward in a radial direction. In addition, the graph at the lower left of FIG. 6 is a graph (graph of the solid line) showing the relationship between the position in the radial direction and the magnetic field on the median plane MP of the regenerator 140. In addition, a graph indicated by the one-dot chain line shows the inclination of the graph of the solid line. In addition, in the graph, a magnetic field by the magnetic channel is not superimposed.

However, since the relationship of d1=d2 is satisfied in the magnetic members for a regenerator 141A and 141B in the comparative example, the amount of the magnetic members for a regenerator 141A and 141B in a region on the outer side of the centerline CL of the apex 144 in the radial direction is increased. Therefore, the graph of the solid line showing the magnetic field becomes a shape indicating an approximately normal distribution, and a region where the high magnetic field is gradually decreased is formed on the outer side of the centerline CL of the apex 144 in the radial direction as indicated by E3 of the graph. A region of high magnetic field is formed within a certain range on the outer side in the radial direction. When trying to reduce the size of a cyclotron by arranging the magnetic channel close to such a regenerator 140, the orbit of the beam C passing through the regenerator 140 is brought close to the extraction orbit of the beam C passing through a magnetic channel adjacent to the regenerator 140 on the outside in a radial direction. In such a case, since a high magnetic field on the outer side in the radial direction that is generated by the regenerator 140 interferes with a magnetic field generated by the magnetic channel, the beam C passing through the magnetic channel may not be satisfactorily extracted. On the other hand, since a magnetic field generated by the magnetic channel interferes with a magnetic field generated by the regenerator 140, a resonance state may be destroyed and the beam C may not be able to be moved outward in a radial direction satisfactorily. Therefore, in the cyclotron in the comparative example, in order to accurately extract the beam C of charged particles, the regenerator 140 and the magnetic channel should be separated from each other to some extent in the radial direction. For this reason, there has been a problem in that it is difficult to reduce the size of the cyclotron.

In addition, in the regenerator 140 of the cyclotron in the comparative example, as indicated by E1 of the graph, a region where the magnetic field is smaller than 0 is formed in a wide range on the inner side in the radial direction than the region of E2 where the magnetic field increases. If such a region is formed, action to move the beam C to the opposite side (inner side in the radial direction) to a direction in which the beam C needs to be moved (outer side in the radial direction) occurs. Accordingly, there is a possibility that the orbit of the beam C will be distorted.

Figure 5:
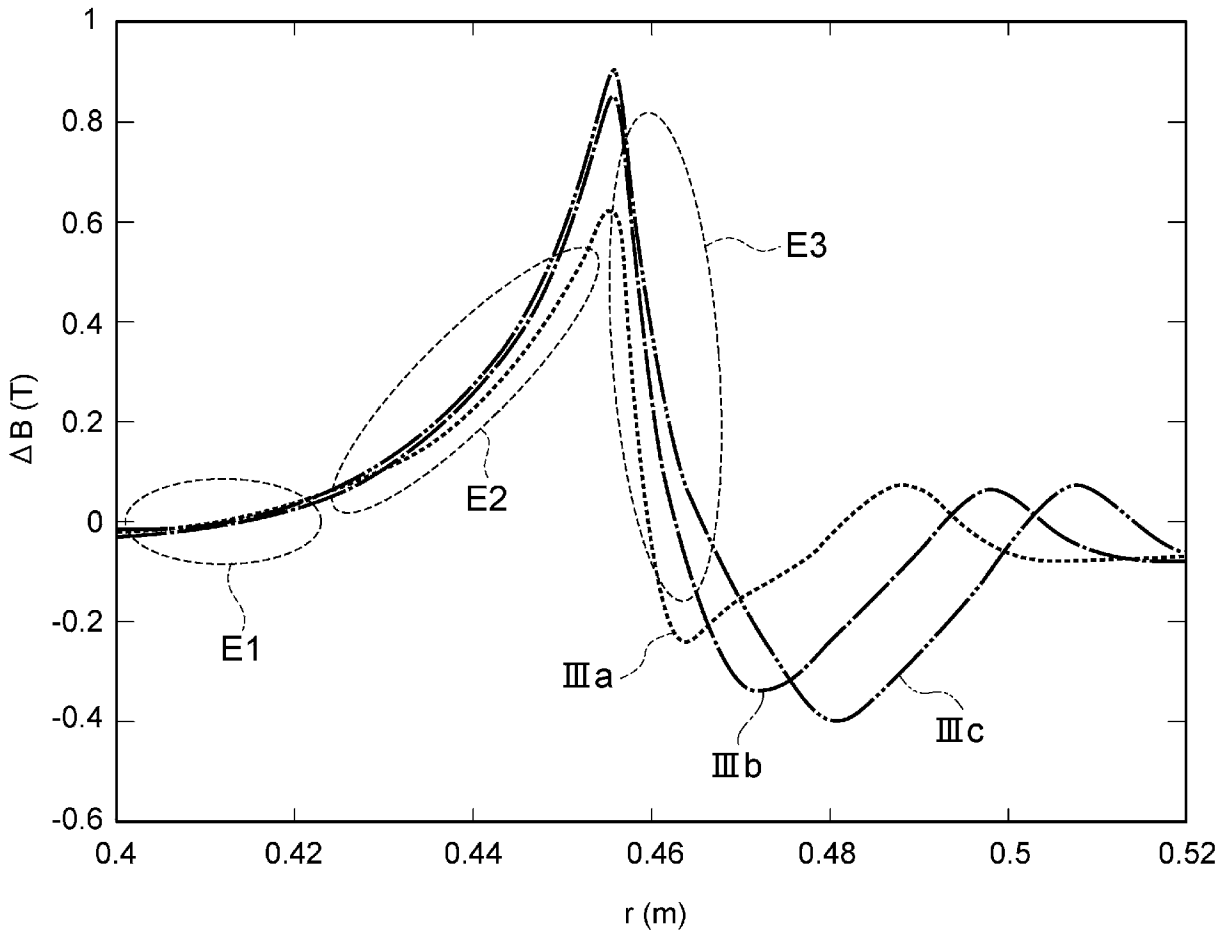
FIG. 5 is a graph showing the relationship between the magnetic field and the radial position in the median plane.

In contrast, in the cyclotron 1 according to the present embodiment, each of the magnetic members for a regenerator 41A and 41B of the regenerator 40 includes a first portion that approaches the median plane MP as it goes outward in a radial direction, and has the apex 44 closest to the median plane MP. Therefore, since a region where the magnetic field increases can be formed from the inner side in the radial direction to the apex 44 like a region indicated by E2 of the graph in FIG. 5, it is possible to move the beam C outward in a radial direction by making the beam C of charged particles pass through the region. In addition, graphs shown in FIG. 5 is a graph showing the relationship between the position in the radial direction and the magnetic field on the median plane MP. These graphs show the magnetic fields of the regenerator 40 and the second magnetic channel 20 that are superimposed on each other. The dotted graph shows a magnetic field on a cross-section taken along the line IIIa-IIIa of FIG. 2, the graph of the one-dot chain line shows a magnetic field on a cross-section taken along the line IIIb-IIIb of FIG. 2, and the graph of the two-dot chain line shows a magnetic field on a cross-section taken along the line IIIc-IIIc of FIG. 2.

On the other hand, when viewed from the circumferential direction, assuming that the distance between the centerline CL of the apex 44 in the radial direction and the first reference position ST1 set on the radially inner end 61 side of the first portion 42 (here, set on the side surface 63) is a first distance d1 and the distance between the centerline CL and the second reference position ST2 (here, set as an end 51) set on the radially outer end 51 side of the first portion 42 (here, set on the end 51) is a second distance d2, the relationship that the first distance d1 is greater than the second distance d2 is satisfied. That is, by adopting a configuration, in which the amount of the magnetic members for a regenerator 41A and 41B is suppressed to be low, on the outer side in the radial direction than the centerline CL of the apex 44, it is possible to reduce a magnetic field in a region on the outer side in the radial direction than the centerline CL of the apex 44. Accordingly, even if the second magnetic channel 20 is brought close to the regenerator 40 due to being disposed on the inner side in the radial direction, it is possible to suppress the influence of the magnetic field generated by the regenerator 40 on the extraction of the beam C of charged particles by the second magnetic channel 20. Specifically, as indicated by E3 of the graph in FIG. 5, it is possible to generate an abruptly decreasing magnetic field by heading outward in a radial direction from the point where the magnetic field is highest. Therefore, the extraction of the beam C in the second magnetic channel 20 can be accurately performed due to the second magnetic channel 20. In this manner, it is possible to extract the beam C accurately while reducing the size of the cyclotron 1.

In addition, in the cyclotron 1 according to the present embodiment, the first reference position ST1 is set at a position where a magnetic field, which is larger than ¼ of the magnetic field generated by a portion of the apex 44, is generated. Specifically, when a portion, which has a small amount of magnetic members and corresponds to the flat surfaces 52 and 53 having a little influence on the magnetic member near the apex 22, is present in the first portion 42, the portion is not set at the first reference position ST1, and the first reference position ST1 can be set at a position of the side surface 63 that is a radially inner end of a portion, which corresponds to the flat surfaces 54 to 57 and the apex 44 that largely influence a magnetic field due to largely protruding toward the median plane MP. Accordingly, it is possible to compare the first and second distances in consideration of the substantial influence of the magnetic field.

Figure 11A:
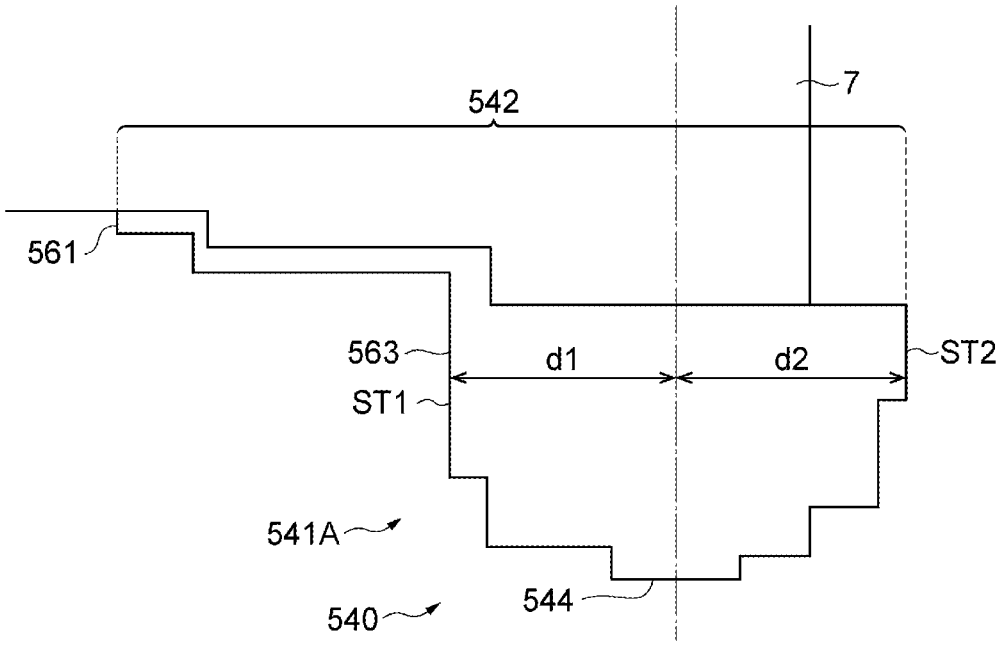
FIGS. 11A and 11B are cross-sectional views for explaining a method of setting the reference position.

For example, a first portion 542 in a magnetic member for a regenerator 541A shown in FIG. 11A is obtained by adding a portion, which extends radially inward in a state where the thickness of the member is small, to the magnetic member for a regenerator 541A having a shape shown at the upper left of FIG. 6. In the magnetic member for a regenerator 541A, a region on the outer side in the radial direction is a portion having a large amount of members. Meanwhile, in a region on the inner side in the radial direction, a thin portion having a small amount of members extends radially inward. In this configuration, the distance between the centerline CL and the radially inner end 561 of the first portion 542 is quite large compared with the distance between the centerline CL and the second reference position ST2 on the outer side in the radial direction. However, since the influence of the portion having a small amount of members on the magnetic field near the apex 544 is not so large, the graph of the magnetic field is not significantly different from the shape indicated by E2 and E3 in the graph at the lower left of FIG. 6. In such a case, it is preferable to set the position of a side surface 563, which largely extends toward the median plane MP, as a first reference position by regarding a portion, which largely influences on the magnetic field near the apex 544, as a reference. When the side surface 563 is set as a first reference position as described above, it can be determined that the condition of d1>d2 is not satisfied since the first distance d1 is equal to the second distance d2.

Figure 11B:
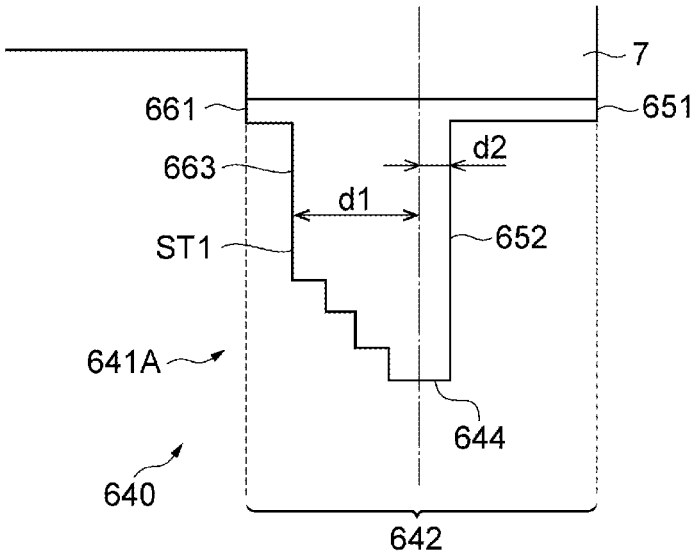

In addition, for example, in a first portion 642 of a magnetic member for a regenerator 641A of a regenerator 640 shown in FIG. 11B, a side surface 652 adjacent to the apex 644 on the outside in a radial direction extends vertically toward the bottom surface of the pole 7. However, near the bottom surface of the pole 7, a thin portion having a small amount of members extends outward in a radial direction. In this configuration, the distance between the centerline CL and the radially outer end 651 of the first portion 642 is equal to the distance between the centerline CL and the end 661 on the inner side in the radial direction. However, the influence of a portion having a small amount of members on the magnetic field near the apex 644 is not so large. Accordingly, in a region on the outer side in the radial direction than the apex 644, it is possible to reduce the magnetic field abruptly similar to E3 of the graph shown in FIG. 5. In such a case, it is preferable to set the position of a side surface 663, which largely extends toward the median plane MP, as a first reference position and set the position of a side surface 652, which largely extends toward the median plane MP, as a second reference position by regarding a portion, which largely influences on the magnetic field near the apex 644, as a reference. When the side surface 652 is set as a second reference position as described above, it can be determined that the condition of d1>d2 is satisfied since the first distance d1 is greater than the second distance d2.

In addition, in the cyclotron 1 according to the present embodiment, the second magnetic channel 20 includes the magnetic member for a magnetic channel 21 disposed on the outer side of the apex 44 of each of the magnetic members for a regenerator 41A and 41B in the radial direction. When viewed from the circumferential direction, assuming that the distance between the centerline CL and the radially inner end 21*a* of the magnetic member for a magnetic channel 21 is a third distance d3, the first distance d1 is equal to or greater than the third distance d3. Thus, by arranging the magnetic member for a magnetic channel 21 of the second magnetic channel 20 close to the magnetic members for a regenerator 41A and 41B, it is possible to reduce the size of the cyclotron 1.

In addition, in the cyclotron 1 according to the present embodiment, the radially outer end 51 of the first portion 42 of each of the magnetic members for a regenerator 41A and 41B is adjacent to the apex 44 on the outside in a radial direction, and is perpendicular to the median plane MP and also extends to the opposite side of the median plane MP. The second reference position ST2 is set at the radially outer end 51 of the first portion 42. By adopting such a configuration, the amount of the magnetic members for a regenerator 41A and 41B in a region on the outer side in the radial direction than the apex 44 can be reduced as much as possible. As a result, it is possible to reduce the magnetic field of the region.

In addition, in the cyclotron 1 according to the present embodiment, each of the magnetic members for a regenerator 41A and 41B has the second portion 43, which protrudes to the median plane MP side, on the inner side in the radial direction than the first portion 42. The second portion 43 protrudes to the median plane MP side more than a portion (flat surface 52) adjacent to the second portion 43 on the outside in a radial direction. As indicated by E1 of the graph at the lower left of FIG. 6, when a region where the magnetic field is lower than 0 is formed on the inner side in the radial direction than the apex 144, the orbit K of the beam C of charged particles may be distorted. However, by providing the second portion 43 protruding to the median plane MP side, it is possible to suppress a reduction in the magnetic field. As a result, since it is possible to make smooth the magnetic field on the inner side in the radial direction, it is possible to reduce the distortion of the orbit of the beam C. For example, as indicated by E1 of the graph of FIG. 5, when the second portion 43 is not provided, some portions in which the magnetic field is lower than 0 are present. However, when the second portion 43 is provided, as indicated by E1 of the graph of FIG. 6, a region where the magnetic field is lower than 0 over a wide range is reduced (distributed over a wide range so that the negative amount is not concentrated in a narrow range), so that the magnetic field gradually increases.

The present invention is not limited to the above-described embodiment.

Figure 7:
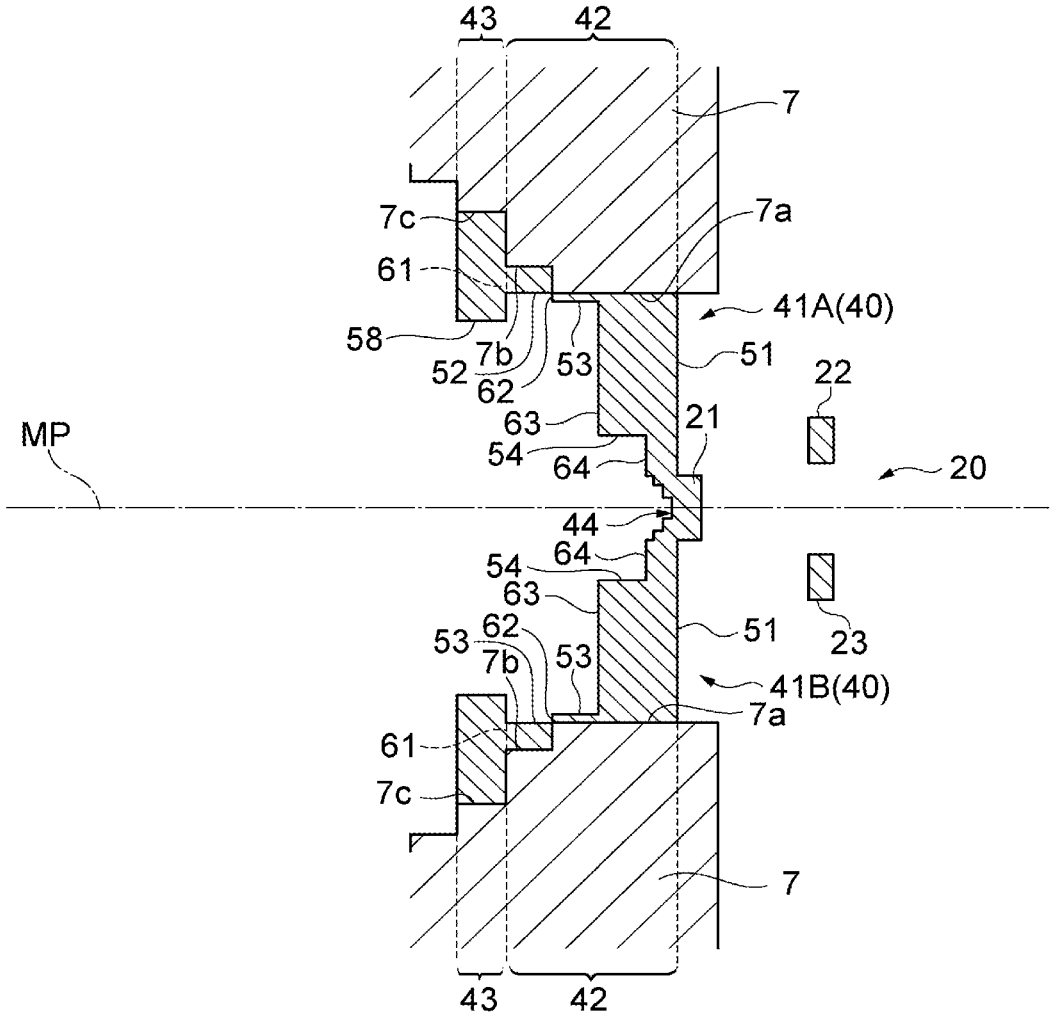
FIG. 7 is a cross-sectional view showing the structure of a regenerator and a second magnetic channel of a cyclotron in a modification.

For example, as shown in FIG. 7, in the radial direction, the magnetic member for a magnetic channel 21 may be brought into contact with the magnetic members for a regenerator 41A and 41B. In this case, since it is possible to arrange the second magnetic channel 20 radially inward further, it is possible to further reduce the size of the cyclotron 1. In addition, each of the magnetic members for a regenerator 41A and 41B may be brought into contact with the magnetic member for a magnetic channel 21 by fixing separate members to each other. Alternatively, a portion corresponding to each of the magnetic members for a regenerator 41A and 41B may be brought into contact with a portion corresponding to the magnetic member for a magnetic channel 21 by forming respective members integrally.

Figure 8:
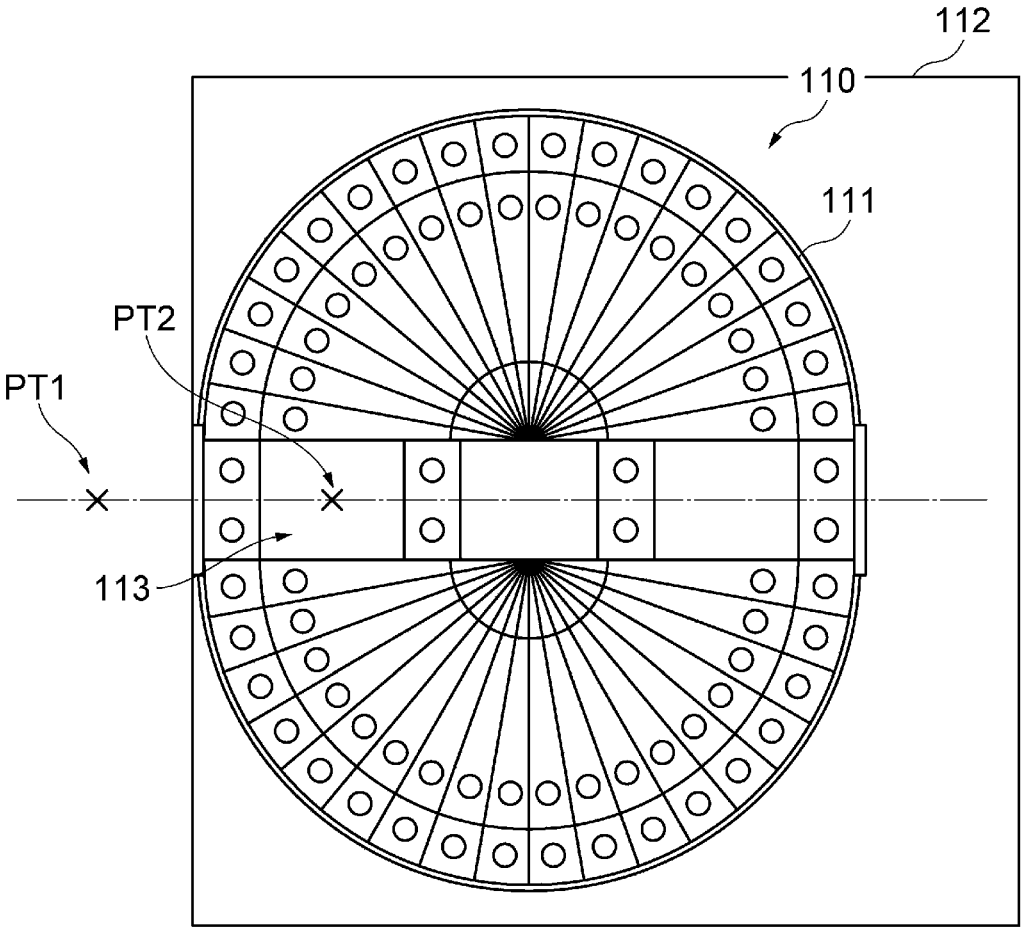
FIG. 8 is a diagram showing the structure of a first magnetic channel of a cyclotron in a modification.

In addition, the cyclotron 1 according to the present embodiment may include another first magnetic channel 110 provided on the upstream side of the second magnetic channel 20 in the direction of the beam C and on the downstream side of the regenerator 40 in the direction of the beam C, and the first magnetic channel 110 may be formed of a coil 111 shown in FIG. 8. As shown in FIG. 8, the first magnetic channel 110 is formed of the coil 111 housed in a coil case 112, and a beam tube 113 through which the beam C passes is provided in the coil 111. The beam C to be put on the extraction orbit D passes through a passage point PT2 in the beam tube 113. On the other hand, according to this configuration, since it is possible to reduce the leakage magnetic field with respect to the outside of the coil 111, it is possible to reduce the influence of the leakage magnetic field on the beam C on the orbit K passing through the passage point PT1 on the outer side of the coil 111. Thus, the beam C of charged particles can be easily extracted.

Figure 9:
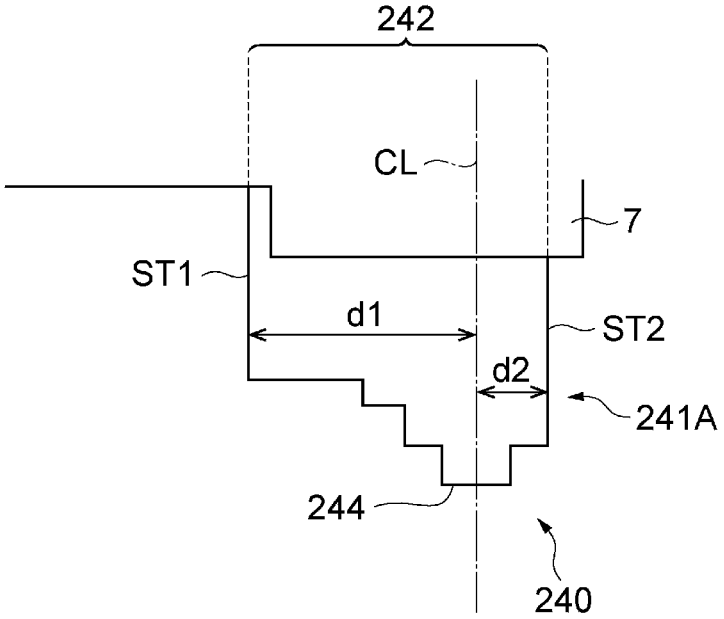
FIG. 9 is a cross-sectional view showing the configuration of a regenerator of a cyclotron in a modification.

For example, when a magnetic member for a regenerator 241A does not have a thin extending portion, which has a small amount of members, on the inner side in the radial direction as in a regenerator 240 shown in FIG. 9, a radially inner end of a first portion 242 may be set at the first reference position ST1. In addition, as shown in FIG. 3, aside surface that extends vertically to the opposite side of the median plane MP and reaches the pole 7 may not be formed on the outside in a radial direction from the apex 244. In addition, a magnetic member for a regenerator may be away from the median plane MP stepwise as the magnetic member for a regenerator 241A shown in FIG. 9.

Figure 10A:
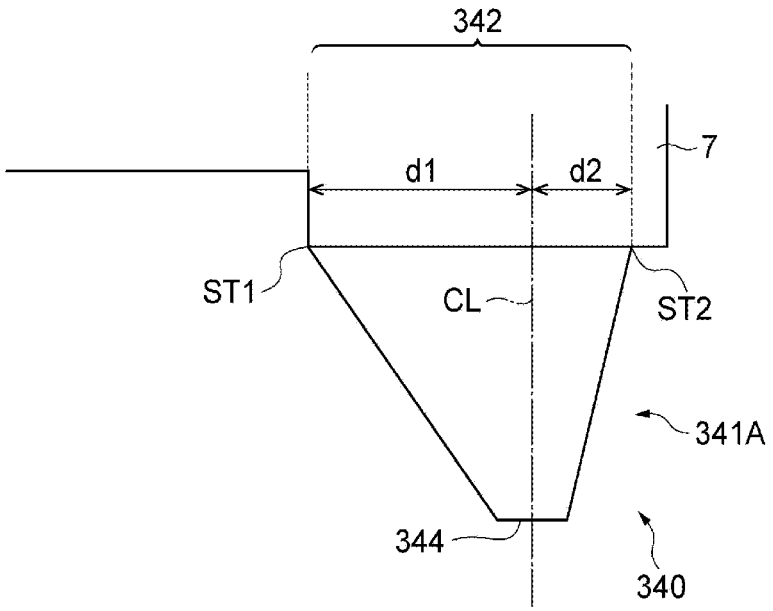
FIGS. 10A and 10B are cross-sectional views showing the configuration of a regenerator of a cyclotron in a modification.
Figure 10B:
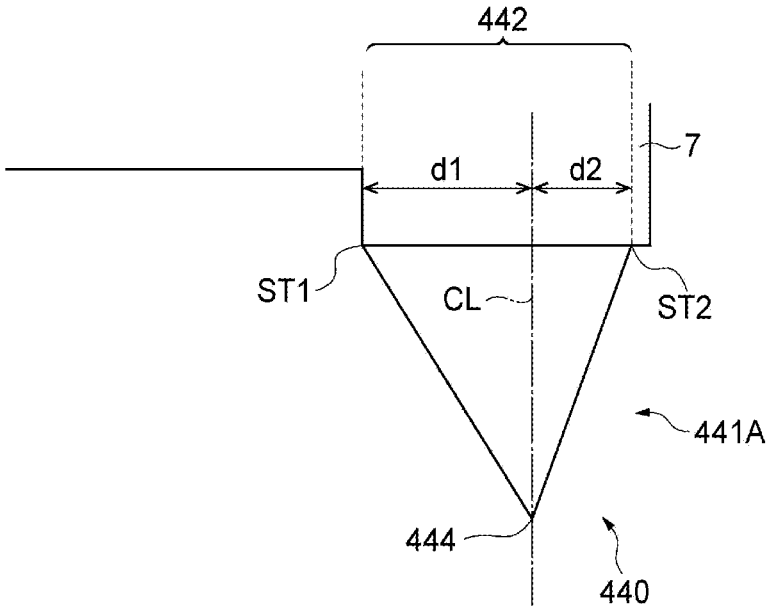

In addition, in the above-described embodiment, the distance of each portion of the magnetic member for a regenerator from the median plane MP changes stepwise due to the portion having a stepwise shape. However, the distance may be changed in an inclined manner as in regenerators 340 and 440 shown in FIGS. 10A and 10B. A first portion 342 of a magnetic member for a regenerator 341A of the regenerator 340 shown in FIG. 10A has inclined surfaces on the inner and outer sides of the apex 344 in the radial direction. In this case, points at which the inclined surfaces and the bottom surface of the pole 7 intersect with each other are the reference position ST1 and ST2. In addition, as in a first portion 442 of a magnetic member for a regenerator 441A of the regenerator 440 shown in FIG. 10B, an apex 444 closest to the median plane MP may not be a flat surface parallel to the median plane MP or may be an apex of the corner where the inclined surfaces intersect with each other. Alternatively, the apex may be rounded in an arc shape. In addition, when the apex is rounded in an arc shape, a point closest to the median plane MP corresponds to the apex. In addition, although the magnetic member for a regenerator has a linearly stepwise shape as in the above-described embodiment, it is also possible to provide a step difference in a curved manner. That is, although a portion where the flat surface and the side surface intersect with each other is a right-angle corner in the above-described embodiment, R may be set to provide a step difference in a curved manner.

Similarly, the pole 7 may be formed not to have a linearly stepwise shape, and a step difference may be provided in a curved manner.

It should be understood that the invention is not limited to the above-described embodiment, but may be modified into various forms on the basis of the spirit of the invention. Additionally, the modifications are included in the scope of the invention.

What is claimed is:

1. A cyclotron, comprising:

a regenerator configured to move a beam of a charged particle on an orbit outward in a radial direction; and a first magnetic channel configured to put the beam on an extraction orbit, wherein the regenerator includes a pair of regenerator magnetic members facing each other with a median plane of the beam interposed therebetween, each of the regenerator magnetic members includes a first portion that extends from a radially inner end to a radially outer end and includes an apex centered around a centerline perpendicular to the median plane, between the radially inner end and the centerline, the first portion monotonically becomes nearer to the median plane as a radial distance from a center of the cyclotron increases, and the first portion satisfies the relationship d1>d2, where d1 is a radial distance between the centerline and a first reference position, d2 is a radial distance between the centerline and a second reference position, the first reference position is located on a radially inner end side of the first portion, and the second reference position on a radially outer end side of the first portion.

2. The cyclotron according to claim 1, wherein the second reference position is located at the radially outer end of the first portion.

3. The cyclotron according to claim 1, wherein a magnitude of a magnetic field generated by the regenerator magnetic members at the first reference position is about ¼ of a magnitude of the magnetic field generated by the regenerator magnetic members at the apex.

4. The cyclotron according to claim 1, wherein the first magnetic channel includes a first channel magnetic member disposed on a radially outer end side of the regenerator magnetic member, and the cyclotron satisfies the relationship d1>d3, where d3 is a radial distance between the centerline and a radially inner end of the first channel magnetic member.

5. The cyclotron according to claim 1, wherein the radially outer end of the first portion is adjacent to a radially outer end of the apex, and is perpendicular to the median plane and extends to an opposite side of the median plane, and the second reference position is located at the radially outer end of the first portion.

6. The cyclotron according to claim 1, wherein the regenerator magnetic member includes a second portion located on the radially inner end side of the first portion, and a median-plane-facing surface of the second portion is nearer to the median plane than a median-plane-facing surface of the first portion at the radially inner end of the first portion.

7. The cyclotron according to claim 4, wherein the first channel magnetic member is in contact with the regenerator magnetic member.

8. The cyclotron according to claim 1, further comprising:

a second magnetic channel that is located on an upstream side of the first magnetic channel in a direction of the beam and on a downstream side of the regenerator in the direction of the beam, wherein the second magnetic channel is formed of a coil.

9. The cyclotron according to claim 1, wherein the cyclotron is a synchrocyclotron.

10. A cyclotron, comprising:

a regenerator configured to move a beam of charged particles on an orbit outward; and a first magnetic channel configured to put the beam on an extraction orbit, wherein the regenerator includes a pair of regenerator magnetic members facing each other with a median plane of the beam interposed therebetween, each of the regenerator magnetic members includes a first portion that has a cross-sectional shape that extends toward the median plane and tapers to an apex centered around a centerline perpendicular the median plane, and the first portion satisfies the relationship d1>d2, where d1 is a radial distance between the centerline and a first face of the first portion, the first face located radially inward relative to the apex, and d2 is a radial distance between the centerline and a second face of the first portion, the second face located radially outward relative to the apex.

11. The cyclotron according to claim 10, wherein the second face is an outmost end face of the first portion.

12. The cyclotron according to claim 10, wherein a magnitude of a magnetic field generated by the regenerator magnetic members at the first face is about ¼ of a magnitude of the magnetic field generated by the regenerator magnetic members at the apex.

13. The cyclotron according to claim 10, wherein the first magnetic channel includes a first channel magnetic member disposed on an radially outer side of the regenerator magnetic member, and the cyclotron satisfies the relationship d1>d3, where d3 is a radial distance between the centerline and a radially inner end of the first channel magnetic member.

14. The cyclotron according to claim 10, wherein the second face corresponds to a radially outer end of the first portion, and the second face is adjacent to the apex, is perpendicular to the median plane, and extends from the apex away from the median plane.

15. The cyclotron according to claim 10, wherein the regenerator magnetic member includes a second portion that has a cross-sectional shape that extends toward the median plane, the second portion located radially inward relative to the first portion, and a median-plane-facing surface of the second portion is nearer to the median plane than a median-plane-facing surface of the first portion at the first face.

16. The cyclotron according to claim 13, wherein the first channel magnetic member is in contact with the regenerator magnetic member.

17. The cyclotron according to claim 10, further comprising:

a second magnetic channel that is located on an upstream side of the first magnetic channel in a direction of the beam and on a downstream side of the regenerator in the direction of the beam, wherein the second magnetic channel is formed of a coil.

18. The cyclotron according to claim 10, wherein the cyclotron is a synchrocyclotron.

19. The cyclotron according to claim 10, wherein the cross-sectional shape is such that, between an innermost end of the first portion and the apex, a distance between the first portion and the median plane monotonically decreases as a radial distance from a center of the cyclotron increases.

* * * * *